US009548177B2

(12) United States Patent
Hou et al.

(10) Patent No.: US 9,548,177 B2
(45) Date of Patent: Jan. 17, 2017

(54) SMART FUSE FOR CIRCUIT PROTECTION

(71) Applicant: LITTELFUSE FRANCE SAS, Paris (FR)

(72) Inventors: Dapeng Hou, Montgeroult (FR); Philippe Difulvio, Le Deluge (FR)

(73) Assignee: LITTELFUSE FRANCE SAS, Paris (FR)

( * ) Notice: Subject to any disclaimer, the term of this patent is extended or adjusted under 35 U.S.C. 154(b) by 155 days.

(21) Appl. No.: 14/455,809

(22) Filed: Aug. 8, 2014

(65) Prior Publication Data

US 2016/0042904 A1 Feb. 11, 2016

(51) Int. Cl.

| | |
|---|---|
| ***H01H 85/06*** | (2006.01) |
| ***H01H 85/36*** | (2006.01) |
| ***H01H 85/00*** | (2006.01) |
| ***H01H 37/76*** | (2006.01) |

(52) U.S. Cl.

CPC ..... *H01H 85/36* (2013.01); *H01H 37/761* (2013.01); *H01H 85/0047* (2013.01); *H01H 85/0052* (2013.01); *H01H 85/06* (2013.01); *H01H 2235/01* (2013.01)

(58) Field of Classification Search

CPC H01H 85/36; H01H 85/0047; H01H 85/0052; H01H 37/761; H01H 85/06; H01H 2235/01

USPC ..... 337/407

See application file for complete search history.

(56) References Cited

U.S. PATENT DOCUMENTS

| | | | | |
|---|---|---|---|---|
| 1,352,117 | A * | 9/1920 | Davis | H01T 1/14 313/261 |
| 2,320,494 | A * | 6/1943 | Wallace | H01H 85/42 337/239 |
| 2,337,820 | A * | 12/1943 | Hodnette | H01H 75/04 337/110 |
| 2,400,491 | A * | 5/1946 | Duerkob | H01H 85/36 337/164 |
| 3,281,559 | A * | 10/1966 | Ebensteiner | H01H 37/765 337/403 |
| 3,863,188 | A | 1/1975 | Knapp | |
| 4,001,754 | A * | 1/1977 | Plasko | H01H 37/765 337/403 |
| 4,189,697 | A * | 2/1980 | Hara | H01H 37/765 337/407 |

(Continued)

OTHER PUBLICATIONS

International Search Report and Written Opinion for International Application No. PCT/IB2015/055663, mailed Dec. 17, 2015.

*Primary Examiner* — Anatoly Vortman

(57) ABSTRACT

A smart fuse for circuit protection includes a first shaft and second shaft separated by a gap. A heater is located inside portions of the first and second shafts, and the heater is held in place within the shafts by a solder alloy that fills the gap. The shafts and solder alloy form an electrical signal path through the fuse. A spring is attached to the heater. The spring is stretched such that the spring exerts a force on the heater. The solder alloy holds the heater in place and resists the force exerted by the spring. In an activation condition of the fuse, the heater increases in temperature and melts the solder alloy. The melted solder alloy no longer resists the force exerted by the spring, and the spring pulls the heater through the second shaft until the gap is open, thereby severing the electrical connection through the fuse.

24 Claims, 6 Drawing Sheets

(56) References Cited

U.S. PATENT DOCUMENTS

| | | | | | |
|---|---|---|---|---|---|
| 4,593,262 | A * | 6/1986 | Krueger | H01H 85/36 | 337/163 |
| 4,821,010 | A * | 4/1989 | Plasko | H01H 61/02 | 337/183 |
| 4,888,573 | A * | 12/1989 | Dunn | H01H 85/36 | 337/164 |
| 5,280,262 | A * | 1/1994 | Fischer | H01H 37/761 | 337/402 |
| 5,473,303 | A * | 12/1995 | Hohider | H01H 37/765 | 337/401 |
| 5,600,295 | A * | 2/1997 | Kaufmann | H01H 37/761 | 337/402 |
| 5,612,662 | A * | 3/1997 | Drekmeier | H01H 37/761 | 29/623 |
| 5,770,993 | A * | 6/1998 | Miyazawa | H01C 7/13 | 337/142 |
| 5,831,507 | A * | 11/1998 | Kasamatsu | H01H 9/10 | 337/299 |
| 5,896,080 | A * | 4/1999 | Chen | H01H 37/761 | 337/401 |
| 7,330,098 | B2 * | 2/2008 | Yoshikawa | H01H 37/765 | 337/401 |
| 2010/0219929 | A1 * | 9/2010 | Lee | H01H 37/765 | 337/182 |
| 2012/0194315 | A1 | 8/2012 | Matthiesen et al. | | |
| 2014/0035716 | A1 | 2/2014 | Doblack et al. | | |

* cited by examiner

SMART FUSE FOR CIRCUIT PROTECTION

BACKGROUND

I. Field

The present invention relates generally to electronic protection circuitry. More, specifically, the present invention relates to a smart fuse.

II. Background Details

Protection circuits are often times utilized in electronic circuits to isolate failed circuits from other circuits. For example, the protection circuit may be utilized to prevent electrical or thermal fault condition in electrical circuits, such as in electric vehicle batteries. Protection circuits may also be utilized to guard against more serious problems, such as a fire caused by a power supply circuit failure.

While progress has been made in providing improved circuit protection devices, there remains a need for improved circuit protection devices. For example, in electric vehicle batteries a circuit protection device is needed to effectively disconnect a cell of the battery from the rest of the battery circuitry in case of abnormal conditions.

SUMMARY

A smart fuse for circuit protection includes a first shaft and second shaft separated by a gap. A heater is located inside portions of the first and second shafts, and the heater is held in place within the shafts by a solder alloy that fills the gap. The shafts and solder alloy form an electrical signal path through the fuse. A spring is attached to the heater. The spring is stretched such that the spring exerts a force on the heater. The solder alloy holds the heater in place and resists the force exerted by the spring. In an activation condition of the fuse, the heater increases in temperature and melts the solder alloy. The melted solder alloy no longer resists the force exerted by the spring, and the spring pulls the heater through the second shaft until the gap is open, thereby severing the electrical connection through the fuse.

DETAILED DESCRIPTION

Figure 1:
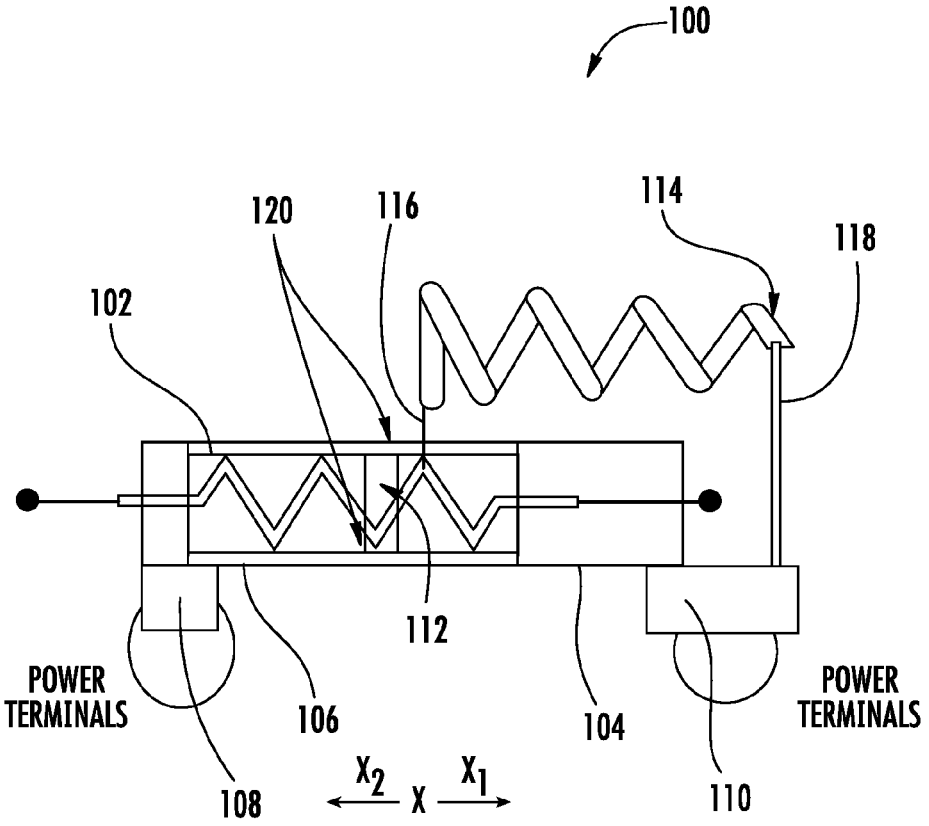
FIG. 1 shows elements of a smart fuse for circuit protection.

FIG. 1 shows elements of a smart fuse 100 for circuit protection. The fuse includes a heater 102, and first shaft 104 and a second shaft 106. Portions of the heater 102 are located within each of the first and second shafts 104, 106. The first shaft 104 is in electrical contact with a first power terminal 108, and the second shaft 106 is in electrical contact with a second power terminal 110. The fuse 100 includes a space, or gap 112, defined between the first shaft 104 and the second shaft 106 along the X direction shown in FIG. 1. The first and second shafts 104, 106 may be copper, nickel, silver, aluminum, or other like metals. The fuse 100 also includes a spring 114, such as a coil spring, with one end of the spring 114 connected to the heater 102 and another end of the spring 114 connected to the second power terminal 110. The spring 114 and the connections 116, 118 between the spring and heater 102, second power terminal 110, respectively, may be made of a conductive material to provide an electrical connection between the heater 102 and second power terminal 110 through the spring 114.

The fuse 100 may further include a solder alloy 120 between the outside surface of the heater 102 and inside surfaces of the shafts 104, 106 around neat the gap 112. In this manner, when the spring 114 is in tension by being stretched, the hardened solder alloy 120 between the heater 102 and shafts 104, 106 holds the heater 102 in place and resists the force of the spring 102 in tension. The solder alloy 120 provides an electrical connection between the first and second shafts 104, 106. When the solder alloy 120 melts, the spring 114 is allowed to compress, thus pulling the heater 102 through the shafts 104, 106 in the X1 direction towards the second power terminal 110. The spring 114 is pulled sufficiently far through the shafts 104, 106 such that the heater 102 is no longer within any portion of the first shaft 104, thus leaving the gap 112 open and severing the electrical connection between the shafts 104, 106, which also results in severing the electrical connection between power terminals 108, 110. The melting of the solder alloy 120 and severing the connection between the power terminals 108, 110 is referred to herein as activation of the fuse 100.

The fuse 100 may be activated under a variety of conditions. For example, the solder alloy 120 may melt under an overtemperature condition of the circuit in which the fuse 100 is installed. For example, if the solder alloy 120 has a melting point of 20° C., the fuse will be activated when the temperature of the device exceeds 20° C. The fuse 100 may also be activated by an external activation signal. Each end of the heater 102 may be connected to an external activation device such that an activation signal is supplied through the heater 102. The activation signal of sufficient amperage may cause the heater 102 to heat to above the melting point of the solder alloy 120, and cause the solder alloy to melt, thereby activating the fuse 100.

Figure 2:
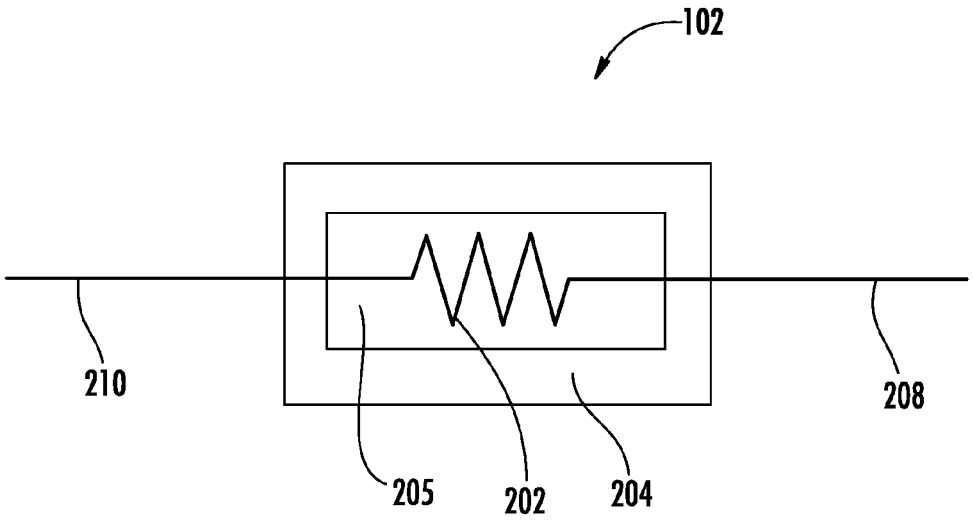
FIG. 2 shows an example of the heater of the fuse shown in FIG. 1.

FIG. 2 shows an example of the heater 102 of the fuse 100 shown in FIG. 1. The heater 102 may include a heater resistor 202 within a cylindrical container 204 made of a low resistivity metal, such as copper. The heater resistor 202 is a resistor that heats up when a current is applied through the resistor 202. The heater 102 may be filled with a material 205 within the container 204 and surrounding the heater resistor 202 that provides electrical isolation between the heater resistor 202 and the container 204. The material 205 may be a powder with a thermal conductivity that allows heat flow from the heater resistor 202. For example, the powder may include boron nitride, silicon dioxide, alumina, aluminum nitride, aluminum oxide, titanium dioxide, silicon carbide, chemical vapor deposition (CVD) diamond or diamond-like carbon (DLC), graphite, quartz, magnesia powder, ceramic, or another material that exhibits a high thermal conductivity property while providing electrical insulation.

The ends 208, 210 of the heater may be electrically connected to an activation device. When the external activation device applies an activation signal through the heater 102, the resistor 202 and in turn the container 204 heat up, causing a solder alloy that is in contact with the container 204 to melt. The amount of time it takes to melt the solder alloy may depend on the current applied to the heater 102, on the resistance of the heater resistor 202, as well as on other factors. For example, a 17 ampere current applied to a 20 μOhm resistor may take approximately 54 seconds to melt the solder alloy sufficiently to cause the fuse to open. In another example, a 6 ampere current applied to a 250 μOhm resistor may take approximately 272 seconds to melt the solder alloy sufficiently to cause the fuse to open. In one embodiment, the power required to activate the fuse may be approximately 120 watts, and may depend on the size of the heater, i.e., the power required to activate the fuse is proportional to the size of the heater.

Figure 3:
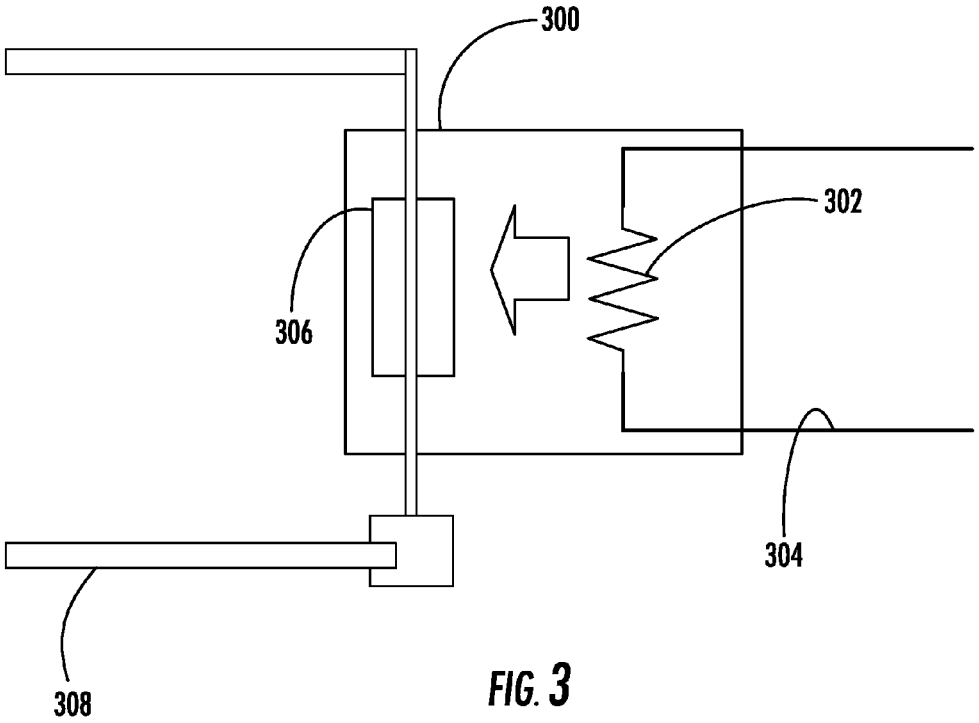
FIG. 3 shows a block diagram of an example of a smart fuse.

FIG. 3 shows a block diagram of an example of a smart fuse 300. The fuse 300 includes a heater 302 connected in an activation signal path 304 and a shaft 306 connected in a power signal path 308. The resistance of the power signal path may be about 20 μOhm. While the block diagram represents the shaft 306 as a single element, will be understood, as shown in FIG. 1 and described above, that the shaft 306 includes two separate pieces. The electrical connection of the power path 308 through the shaft 306 passes through the two shaft parts and through the solder alloy that is present in the gap between the two shaft parts, as described above. When an activation signal is applied to the activation signal path 304, the heater 302 heats up and applies heat (represented by the arrow pointing from the heater 302 to the shaft 306) to the shaft 306 and solder alloy, causing the solder alloy to melt and severing the electrical connection between the who parts of the shaft. In this manner the power signal path 308 is severed.

Figure 4:
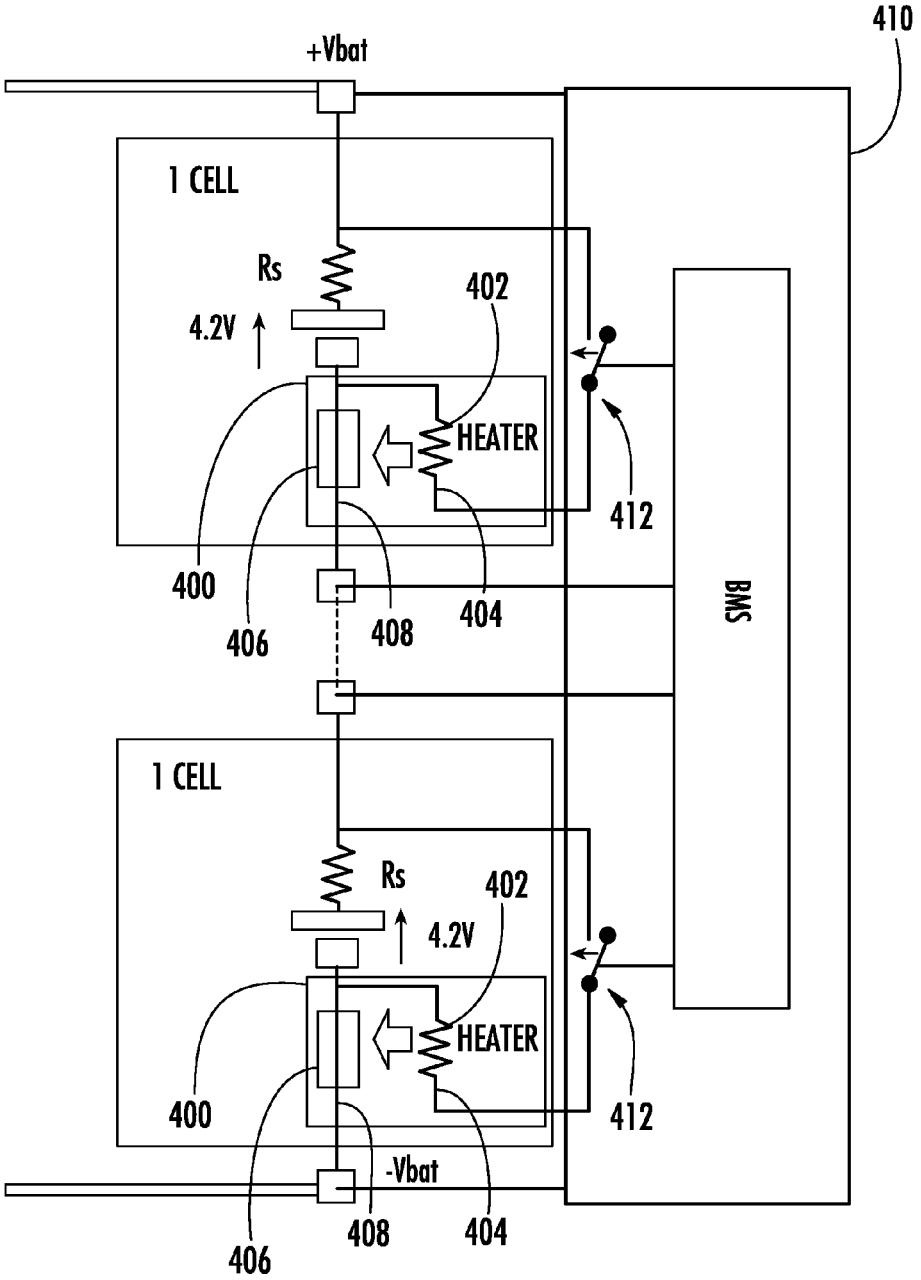
FIG. 4 shows a block diagram of two of fuses shown in FIG. 3 connected in series.

FIG. 4 shows a block diagram of two of fuses 400 shown in FIG. 3 connected in series. Each fuse 400 includes a heater 402, activation signal path 404, shaft 406 and power signal path 408. In this example, an external activation device 410 (e.g., a battery management system (BMS)) is connected to the activation signal paths 404 of each fuse 400. The device 410 includes switches 412 or other circuitry that allows the device 410 to selectively determine which fuses 400 to activate.

Figure 5:
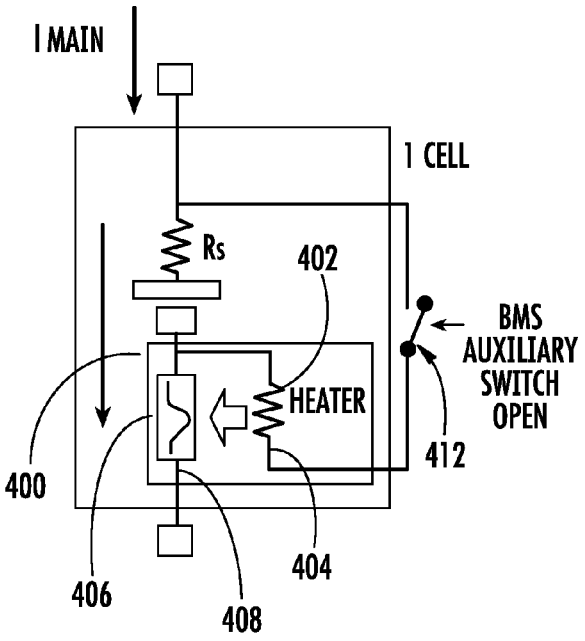
FIG. 5 shows a block diagram of the fuse shown in FIG. 4 under normal operating conditions.
Figure 6:
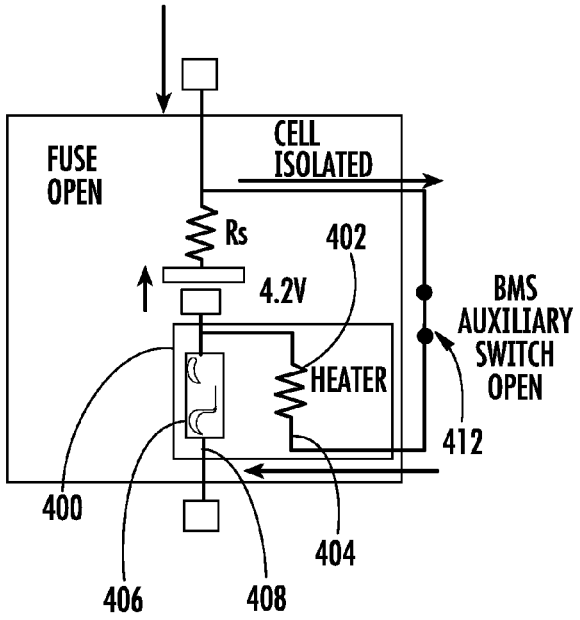
FIG. 6 shows a block diagram of the fuse shown in FIG. 4 under an overcharge condition.

FIGS. 5 and 6 shows a block diagram of the fuse 400 under normal operating conditions and under an overcharge condition, respectively. As can be seen in FIG. 5, under normal conditions (FIG. 5) the current associated with the power signal flows through the shaft 406, and the activation signal path 404 is open. During an overcharge condition (FIG. 6) the device 410 may the switch 412, the current flows into the heater 402 through the activation signal path 404 until the temperature of the heater 402 is enough to melt the solder alloy holding the two shaft parts of the shaft 406, thereby opening the power signal path 408.

Figure 7:
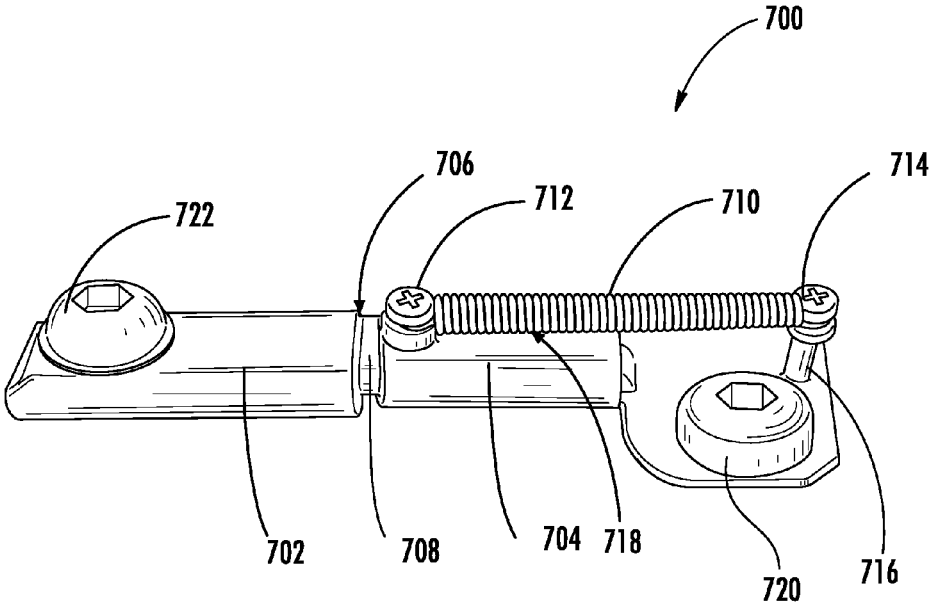
FIG. 7 shows an example of a smart fuse.

FIG. 7 shows an example of a smart fuse 700. The fuse 700 includes a first shaft 702 and a second shaft 704, with a gap 706, or space, between the shafts 702, 704. FIG. 7 shows a solder alloy 708 within the gap 706. In FIG. 7 the shafts have a cylindrical shape, but it will be understood that other shapes may be used. The heater (not shown) is positioned within the shafts 704, 706 and is held in place by the solder alloy 708.

The fuse 700 includes a spring 710 stretched between two spring connections 712, 714. The spring connections 712, 714 in FIG. 7 are screws, but it will be understood that other mechanisms may be used to connect the spring 710 to the fuse 700. The spring connection 714 is connected to the power terminal 716, which may be a conductive (metal) plate or material. The spring connection 712 is connected to the heater that is inside the shafts 702, 704. In particular, a hole 718 is defined on the top surface of the shaft 704 through which the spring connection 712 passes. The hole 718 extends along the top surface for almost the length of the shaft 704. When the solder alloy 708 melts under one of the activation conditions discussed herein, the solder alloy 708 no longer resists the decompression force of the spring 710 and the spring 710 decompresses. Because the spring connection 712 is connected to the heater, the decompressing spring 710 pulls the heater through the shaft 714 towards the other spring connection 714. The elongated hole 716 in the top of the shaft 704 allows the spring connection 712 to slide towards the spring connection 714 while still being connected to the heater within the shaft 704. The fuse 700 also includes screws 720, 722 which may facilitate attaching the fuse 700 to the underlying circuit it is intended to protect.

The gap 706 may be approximately 3 mm. The cylindrical portion of the shaft 702 may be approximately 13 mm, and the cylindrical portion of the shaft 704 may be approximately 20 mm.

The fuse 700 is armed by stretching the spring 710 to the position shown in FIG. 7 and then applying the solder alloy within the gap 706 and between the heater and inside surface of the shafts 702, 704. When the solder alloy 708 hardens, it holds the heater in place and resists the decompression force of the stretched spring 710. In some examples, the fuse 700 may be subject to reflow. Where the fuse 700 is subject to reflow, the solder alloy 708 may be applied after the reflow process.

While the circuit protection device has been described with reference to certain embodiments, it will be understood by those skilled in the art that various changes may be made and equivalents may be substituted without departing from the scope of the claims of the application. In addition, many modifications may be made to adapt a particular situation or material to the teachings without departing from its scope. Therefore, it is intended that the reflowable circuit protection device is not to be limited to the particular embodiments disclosed, but to any embodiments that fall within the scope of the claims.

What is claimed is:

1. A fuse for circuit protection comprising:

a first shaft comprising a conductive material;

a second shaft comprising a conductive material;

a gap defined between the first and second shafts;

a heater positioned inside a length of the first and second shafts;

a solder alloy connected between the heater and a portion of each of the first and second shafts; and a spring comprising a first end attached to the heater and a second end connected to a first power terminal, wherein the spring exerts a force on the heater in a first direction along an axis of the second shaft and the solder alloy holds the heater in place and resist the force exerted by the spring.

2. The fuse of claim 1, wherein the heater comprises:

a metal container;

a heater resistor located inside the metal container, wherein the heater resistor increases in temperature when a current is applied through the heater resistor; and an insulating material between the heater resistor and the metal container.

3. The fuse of claim 2, wherein the insulating material comprises at least one of boron nitride, silicon dioxide, alumina, aluminum nitride, aluminum oxide, titanium dioxide, silicon carbide, chemical vapor deposition (CVD) diamond or diamond-like carbon (DLC), graphite, quartz, magnesia powder, and ceramic.

4. The fuse of claim 1, wherein the heater is electrically connected to an external activation device that applies an activation current to the heater.

5. The fuse of claim 1, wherein the heater increases in temperature when an activation current is applied to the heater.

6. The fuse of claim 5, wherein when the activation current is applied to the heater, the heater increases to a temperature that exceeds a melting point of the solder alloy.

7. The fuse of claim 1, wherein the solder alloy melts when an activation signal is applied to the heater or during an overtemperature condition in which a temperature of the heater increases to a temperature above the melting point of the solder alloy.

8. The fuse of claim 1, wherein the spring pulls the heater through the second shaft towards the second end of the spring in response to melting e solder alloy such that no portion of heater remains within the first shaft.

9. The fuse of claim 1, wherein a cumulative length of the first shaft, second shaft and the gap between the first and second shaft is approximately 36 millimeters.

10. The fuse of claim 9, wherein the heater comprises:

a metal container;

a heater resistor located inside the metal container, wherein the heater resistor increases in temperature when a current is applied through the heater resistor; and an insulating material between the heater resistor and the metal container.

11. The fuse of claim 10, wherein the insulating material comprises at least one of boron nitride, silicon dioxide, alumina, aluminum nitride, aluminum oxide, titanium dioxide, silicon carbide, chemical vapor deposition (CVD) diamond or diamond-like carbon (DLC), graphite, quartz, magnesia powder, and ceramic.

12. A fuse for circuit protection comprising:

a first power terminal;

a second power terminal; a first shaft comprising a conductive material;

a second shaft comprising a conductive material;

a gap defined between the first and second shafts;

a heater positioned inside a length of the first and second shafts;

a solder alloy connected between the heater and a portion of each of the first and second shafts, wherein the first shaft, second shaft and solder alloy provide an electrical signal path between the first and second power terminals; and a spring comprising a first end attached to the heater and a second end connected to an end of the fuse proximate to the second power terminal, wherein the spring exerts a force on the heater in a first direction along an axis of the second shaft and the solder alloy holds the heater in place and resist the force exerted by the spring.

13. The fuse of claim 12, wherein the heater increases in temperature when an activation current is applied to the heater.

14. The fuse of claim 13, wherein when the activation current is applied to the heater, the heater increases to a temperature that exceeds a melting point of the solder alloy.

15. The fuse of claim 12, wherein the solder alloy melts when an activation signal is applied to the heater or during an overtemperature condition in which a temperature of the heater increases to a temperature above the melting point of the solder alloy.

16. The fuse of claim 12, wherein the spring pulls the heater through the second shaft towards the second end of the spring in response to melting of the solder alloy such that the gap between the first and second shaft is open and the electrical signal path between the first and second power terminals is severed.

17. The fuse of claim 12, wherein a cumulative length of the first shaft, second shaft and the gap between the first and second shaft is approximately 36 millimeters.

18. A fuse for circuit protection comprising:

a first shaft comprising a conductive material;

a second shaft comprising a conductive material, wherein the second shaft comprises a hole defined in an upper surface of the second shaft, and wherein the hole extends almost an entire length of the second shaft;

a gap defined between the first and second shafts;

a heater positioned inside a length of the first and second shafts;

a solder alloy connected between the heater and a portion of each of the first and second shafts; and a spring comprising a first end attached to the heater through the hole defined in the upper surface of the second shaft and a second end connected to a first end of the fuse, wherein the spring exerts a force on the heater in a first direction along an axis of the second shaft and the solder alloy holds the heater in place and resist the force exerted by the spring wherein in response to melting of the solder alloy, the spring pulls the heater towards the second end of the spring a distance equal to a length of the hole defined in the upper surface of the second shaft.

19. The fuse of claim 18, wherein the heater increases in temperature when an activation current is applied to the heater.

20. The fuse of claim 19, wherein when the activation current is applied to the heater, the heater increases to a temperature that exceeds a melting point of the solder alloy.

21. The fuse of claim 18, wherein the first shaft, second shaft and solder alloy provide an electrical signal path through the fuse, and wherein the spring pulls the heater through the second shaft towards the second end of the spring in response to melting of the solder alloy such that the gap between the first and second shaft is open and the electrical signal path is severed.

22. The fuse of claim 18, wherein a cumulative length of the first shaft, second shaft and the gap between the first and second shaft is approximately 36 millimeters.

23. The fuse of claim 18, wherein the heater comprises:

a metal container;

a heater resistor located inside the metal container, wherein the heater resistor increases in temperature when a current is applied through the heater resistor; and an insulating material between the heater resistor and the metal container.

24. The fuse of claim 23, wherein the insulating material comprises at least one of boron nitride, silicon dioxide, alumina, aluminum nitride, aluminum oxide, titanium dioxide, silicon carbide, chemical vapor deposition (CVD) diamond or diamond-like carbon (DLC), graphite, quartz, magnesia powder, and ceramic.

* * * * *